US005752671A

United States Patent [19]

Weber

[11] Patent Number: 5,752,671

[45] Date of Patent: May 19, 1998

[54] HOLLOW CYLINDER WITH FREELY SELECTABLE AXIAL EXTENSION

[75] Inventor: Bruno Weber, Berg, Switzerland

[73] Assignee: Feramatic AG, Bürglen, Switzerland

[21] Appl. No.: 551,615

[22] Filed: Nov. 1, 1995

[30] Foreign Application Priority Data

Nov. 2, 1994 [CH] Switzerland ..... 03 268/94

[51] Int. Cl.[6] ..... B65H 75/24; B65H 75/14; B65H 75/08

[52] U.S. Cl. ..... 242/578; 242/609.1; 242/613

[58] Field of Search ..... 242/578, 578.2, 242/613, 609.1, 608.6

[56] References Cited

U.S. PATENT DOCUMENTS

| | | | |
|---|---|---|---|
| 3,642,223 | 2/1972 | Feichtinger | 242/609.1 |
| 3,759,460 | 9/1973 | Fyans | 242/578 |
| 4,880,181 | 11/1989 | Drahanowsky | 242/609.1 X |
| 4,895,316 | 1/1990 | Salloum | 242/578.2 X |

FOREIGN PATENT DOCUMENTS

| | | |
|---|---|---|
| 0453765 | 10/1991 | European Pat. Off. . |
| 661567 | 7/1934 | Germany . |
| 3810967 | 10/1989 | Germany . |

*Primary Examiner*—John Q. Nguyen

[57] ABSTRACT

A winding core for winding printed products. The core includes two coil parts, each of which includes at least one coiled profile and a step on each of an inner face and an outer face thereof. The step is formed by a corresponding one of two ends of the at least one coiled profile, each coiled profile further including coil windings having cooperating first joining components disposed on axial sides thereof for joining the windings to one another, each coiled profile having a freely selectable axial extension thereby allowing a free selection of an axial extension of the hollow cylinder. Two end rings of the core include second joining components thereon cooperating with the first joining components for axially joining the two end rings to the coil parts, each inner face of each end ring facing a corresponding coil part including a step thereon juxtaposed against and having an axial extension substantially equal to an axial extension of a corresponding step of the corresponding coil part. A middle ring of the core includes third joining components thereon cooperating with the first joining components for axially joining the middle ring to the coil parts, each of two faces of the middle ring facing a corresponding coil part and having a step thereon juxtaposed against and having an axial extension substantially equal to an axial extension of a corresponding step of the corresponding coil part.

10 Claims, 4 Drawing Sheets

HOLLOW CYLINDER WITH FREELY SELECTABLE AXIAL EXTENSION

FIELD OF THE INVENTION

The invention concerns a winding core for winding printed products for forming rolls for intermediate storage, the winding core being shaped substantially as a hollow cylinder having a predetermined outer diameter and a freely selectable axial extension regardless of the method used to produce the same.

BACKGROUND OF THE INVENTION

Hollow cylinders with various i.e.: the diameters and heights (dimension parallel to the cylinder axis) are used for various applications. An exemplary application is the production of rolls from a scale formation of items, wherein the items are, at least within limits, flexible, as e.g. printed products such as newspapers, magazines, brochures or parts of the same. The production of the rolls is effected, by winding the scale formation onto cores which cores are substantially hollow cylinders. Such rolls of printed products can easily be manipulated and stacked and are therefore a popular formation of printed products for intermediate storage. Winding cores using a hollow cylinder for this purpose are e.g. described in the publication EP-0453765 by the same applicant.

The described rolls of printed products can easily be stacked on top of each other with vertical winding axes, providing the winding cores do not extend beyond the rolls axially, that is, in an axial direction of the rolls, i.e. providing the axial extension (height) of each core is not larger than the width of the products wound thereon. On the other hand, especially with products sensitive to deformation, the winding technique leads to the least amount of problems if the axial extension of the winding core is not smaller than the width of the wound products, such that the innermost products on the roll lie on the surface area of the core over their whole width and are therefore kept in a defined position. In other words this means that the winding technique is optimally applicable when the axial height of the winding core is matched as precisely as possible to the width of the products to be wound thereon.

Furthermore, it can be shown that for products to be wound which are sensitive to deformation, winding cores with an outer surface area which is as flat and as continuous as possible are preferable to cores with discontinuous outer surfaces.

SUMMARY OF THE INVENTION

It is an object of the present invention to create a hollow cylinder, especially a hollow cylinder for application as winding core for winding scale formations of printed products, which hollow cylinder has a selectable axial extension (height) and which axial extension can furthermore be easily varied by the user. The cylinder, regardless of its axial height, is to have an outer surface which is as continuous as possible and a cylinder height which is infinitely variable.

The above object is achieved by a winding core for winding printed products. The core includes two coil parts, each of which includes at least one coiled profile and a step on each of an inner face and an outer face thereof. The step is formed by a corresponding one of two ends of the at least one coiled profile, each coiled profile further including coil windings having cooperating first joining means disposed on axial sides thereof for joining the windings to one another, each coiled profile being having a freely selectable axial extension thereby allowing a free selection of an axial extension of the hollow cylinder. Two end rings of the core include second joining means thereon cooperating with the first joining means for axially joining the two end rings to the coil parts, each inner face of each end ring facing a corresponding coil part and including a step thereon juxtaposed against and having an axial extension substantially equal to an axial extension of a corresponding step of the corresponding coil part. A middle ring of the core includes third joining means thereon cooperating with the first joining means for axially joining the middle ring to the coil parts, each of two faces of the middle ring facing a corresponding coil part and having a step thereon juxtaposed against and having an axial extension substantially equal to an axial extension of a corresponding step of the corresponding coil part.

The hollow cylinder according to the invention comprises at least three parts: a middle part and axially joined thereto on both sides an end ring. The middle part consists of at least one piece of a relatively long profile which piece can be of any chosen length (that is, the piece has a freely selectable axial extension) and is formed into an axially closed coil, or coiled profile, by e.g. positive engaging means arranged on the axial sides of the profile, by which engaging means the windings of the coil are interlocked axially. The positive engaging means preferably run continuously over the whole length of the profile. The end rings have at least one step on one of their faces, i.e. their axial extension increases in a step in at least one area of the of the perimeter and decreases continuously over the rest of the perimeter from an extension which corresponds to the one side of the step to an extension which corresponds to the other side of the step. The height of the step is substantially equal to the axial extension of the coiled profile which forms the middle part of the cylinder. Furthermore the stepped face of the end rings is fitted with positive engaging means joinable to the engaging means of the axial sides of the coiled profile such that these faces are interlockable with the coiled profile.

For producing a hollow cylinder according to the invention, a piece of the profile with a length corresponding to the predetermined axial height of the cylinder and to the diameter of the end rings is formed into a coil and the windings of the coil are interlocked with the help of the interlocking means running on the axial sides of the profile. The end rings are joined to the profile coil, by positioning them such that each end of the profile piece is positioned in a step of the face of an end ring, and by interlocking the positive engaging means of the profile and the end rings.

As the profile can have any chosen length and as the mutual position of the steps of the two end rings is of no importance, the axial height, or axial extension of the hollow cylinder to be produced can be set or adjusted at will and infinitely by using profile pieces of a corresponding length.

If the profile and the positive engaging means on its axial sides are formed such that a piece of the profile with a given length can be cut off a longer piece with a simple cutting device, such that the profile can be brought into the intended coil form and joined to the end rings again with simple means, e.g. by hand, and such that the joined windings of the profile as well as the profile coil and the end rings joined thereto can be separated without complicated devices, e.g. by hand, not only production of the hollow cylinder of any chosen height but also the changing of the axial height of such a hollow cylinder is extremely simple.

The minimal height of the hollow cylinder corresponds to the height of two end rings when these are joined without the coiled profile between them, such that the steps of their faces are next to each other and that the positive engaging means arranged on their faces are interlocked.

The coil part of the cylinder may consist of a piece of profile or of a plurality of profile pieces coiled up contiguous to each other.

The profile to be coiled up to form the middle part of the cylinder is e.g. an extruded quasi endless plastic profile which either is sufficiently flexible to be formed into a coil of a given diameter or which is preformed during extrusion as a coil with windings which are not joined axially, whereby the diameter of the preformed coil corresponds more or less, depending on the deformability or elasticity of the profile, to the diameter of the cylinder to be produced.

The positive engaging means on the axial sides of the coiled up profile may e.g. consist of a tongue running along one side of the profile and a groove on the other side such that when brought together the tongue snaps into the groove whereby the tongue and/or the groove is deformed.

The end rings and also the profile may be made of plastic and the end rings may have the same positive engaging means on their faces as the profile. However, the end rings may also be made of e.g. a metal, whereby the positive engaging means arranged on their faces must then be formed according to the elasticity of the specific material of the end ring which may differ from the elasticity of the profile material.

For a hollow cylinder as described above and including two end rings and a middle coil part, the two end rings differ regarding the fact that the positive engaging means of the one ring are joinable to the engaging means of the one profile side whereas the positive engaging means of the other end ring are joinable to the engaging means of the other profile side. In other words, this means that when the one narrow side of the profile has a tongue and the other side has a groove, the one end ring has a tongue, the other a groove.

Further embodiments of the hollow cylinder according to the invention are hollow cylinders which additionally to the two end rings comprise a middle ring. This middle ring comprises two faces which are stepped and advantageously are equipped with identical positive engaging means and the hollow cylinder then consists of the middle ring, coiled parts joined thereto on both sides and two end rings, whereby the end rings have identical engaging means. If the two coiled parts are both left-handed or both right-handed coils, the two end rings are congruent, at least in the area of the stepped face, if one coiled part is left-handed and the other right-handed, the two end rings are like mirrored images of each other. Obviously, hollow cylinders with additional middle rings and more than two coiled parts are possible also.

The coiled part may also include of two or more profile pieces running parallel to each other (double or multiple coil), whereby for such an embodiment the faces of the end rings and possibly those of the middle ring or rings must each have two or more steps. Cylinders with other than circular cross sections, e.g. elliptical cross sections are also thinkable. Furthermore, it is possible to produce cylinders as described above with a cross section that changes over the height thereof, provided that the profile is sufficiently elastic. Producing such cylinders though, is considerably more complicated. For producing frustums or similar bodies either the gradient would additionally have to be adapted according to different heights or end rings with different diameters would be required.

Instead of positive engaging means for interlocking the profile windings and these windings with the faces of the end rings, an integral joint is also thinkable, e.g. an advantageously reversible adhesive joint.

BRIEF DESCRIPTION OF THE DRAWING

With the help of the following FIGS., preferred embodiments of the hollow cylinder according to the invention are described in detail and further embodiments are shown diagrammatically: whereby.

DETAILED DESCRIPTION OF THE INVENTION

Figure 1:
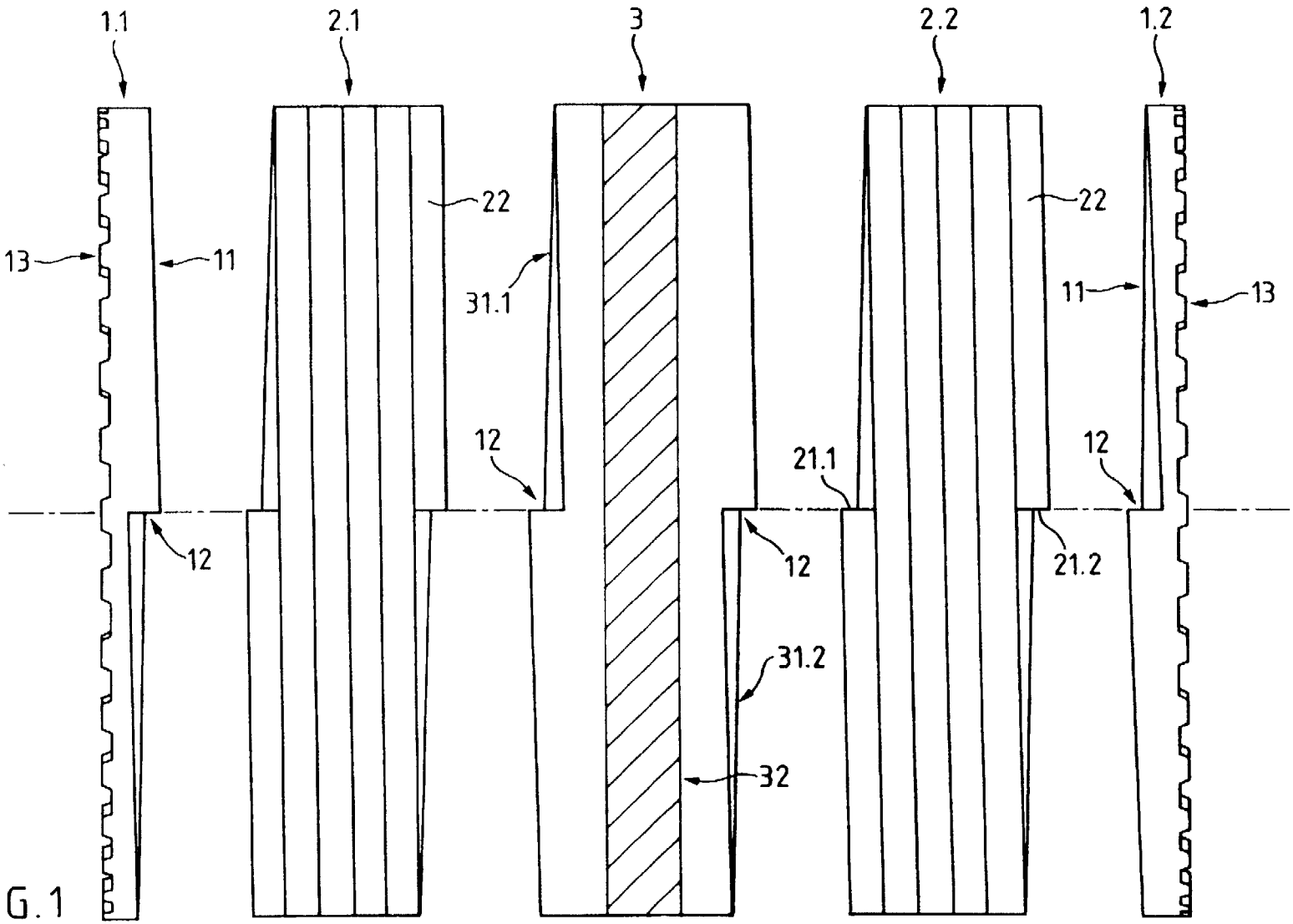
FIG. 1 shows as an exemplified embodiment of the hollow cylinder according to the invention, the five parts of a cylindrical winding core with an axial height that can be set or be adjusted, viewed in a direction its rotational axis.

FIG. 1 shows the five parts of an exemplified embodiment of the hollow cylinder according to the invention viewed of the core in a direction rotational axis. The hollow cylinder is a winding core used in rolls of printed products. The five parts are two end rings 1.1 and 1.2, two coil parts 2.1 and 2.2 and a middle ring 3.

End rings 1.1 and 1.2 each have a stepped face 11 with a step 12 and an outer face 13, which outer face may be equipped e.g. with a tooth profile for increasing the stability of stacked rolls containing such cores, whereby the tooth profiles of contiguous cores interlock. It is noted that, in the instant description, the words "inner" and "outer" mean, respectively facing in a direction toward and away from the middle ring.

Coil parts 2.1 and 2.2 each include a profile piece 22 which has a length that corresponds to five whole coil windings such that the two profile ends 21.1 and 21.2 are in the same radial position. It is noted, however, that the above positioning of the profile ends is by no means a necessary feature for the hollow cylinder according to the invention, but is merely pure coincidence. Both coil parts 2.1 and 2.2, as shown, are right-handed coils.

Middle ring 3 comprises two stepped faces 31.1 and 31.2 each having a step 12. In the center of the middle ring a winding tape is positioned (hatched area 32). In order to maintain the central position of the winding tape when changing the axial extension of the core, it is necessary for the profile pieces 22 of the two coil parts 2.1 and 2.2 to always have an identical length. On the other hand the axial position of the middle piece in the cylinder and therefore also the axial position of the winding tape can be adjusted by the relative length of the two profile pieces.

The height (axial extension) of steps 12 of end rings 1.1 and 1.2 and of middle rings 3 correspond to the width (axial extension) of profile piece 22.

All five parts of FIG. 1 have the same outer diameter which however is not a necessity. It would e.g. be easily possible to equip the end rings with flanges on their outer faces 13 extending away from the rotational axis which flanges could have a larger diameter than the coil parts and could serve to support wound items laterally. Furthermore, it is possible to use two middle rings with one winding tape each and three coil parts and to adjust the axial position of the winding tapes by choosing the relative lengths of the three profile pieces accordingly.

Figure 2:
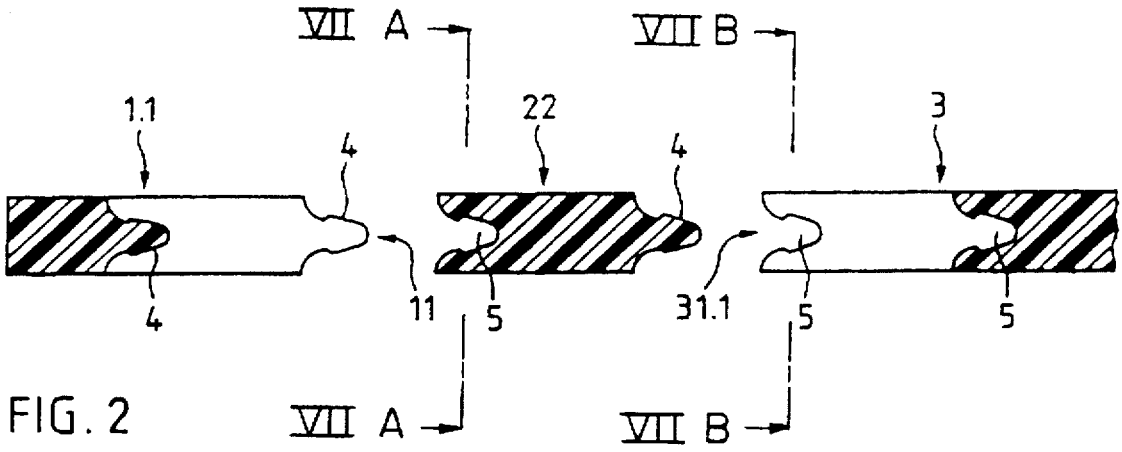
FIG. 2 shows a cross-sectional view of the core of FIG. 1 parallel to its rotational axis through an end ring, through the coiled profile and through the middle ring of the embodiment according to FIG. 1.

FIG. 2 shows a part of an end ring 1.1, the coiled profile 22 and a part of the middle ring 3 in section parallel to the rotational axis of the hollow cylinder. The positive engaging means on the faces 11 and 31.1 of the rings 1.1 and 3 and on the axial sides of the coiled up profile piece 22 are visible in the sections. These positive engaging means are a tongue 4 on the end ring 1.1 and on one of the axial sides of coiled up profile piece 22 and a corresponding groove 5 on the middle ring 3 and on the other axial side of the profile 22. The two rings 1.1 and 3 are intersected in the area of the step such that positive engaging means 4 and 5 are shown on two levels (both sides of the step).

Groove 5 widens out inward of a less wide opening area and tongue 4 comprises a thinner neck area and adjoining the neck area an enlarged head part, whereby the enlarged head part fits into the widened inner area of the groove. Groove 5 and tongue 4 i.e. their enlargements/narrowings and thinner/thicker parts must be adapted to each other according to the elasticity of the materials used, such that tongue 4 can be introduced into and then again removed from groove 5 under elastic deformation of the groove walls and/or the tongue, such that tongue 4 in groove 5 constitutes a sufficiently stable joint.

If the profile is extruded in a coiled form such that the windings in the coil are elastically pressed against each other by a corresponding initial tension it is not necessary that the profile has positive engaging means on its axial sides for interlocking the windings of the profile. It is then sufficient to form e.g. the groove and tongue such that they prevent a radial displacement of the windings against each other and/or an axial compression of the coil.

It is advantageous that at least one of the positive engaging means, i.e. either groove 5 or tongue 4, should run continuously over the whole length of the profile 22 and round the whole perimeter of rings 1.1, 1.2 and 3, while the other one of the engaging means can be alternately interrupted. If both engaging means (groove and tongue) are arranged alternately with gaps it is possible that the diameter of the cylinder cannot be freely selected any more.

Figure 7A:
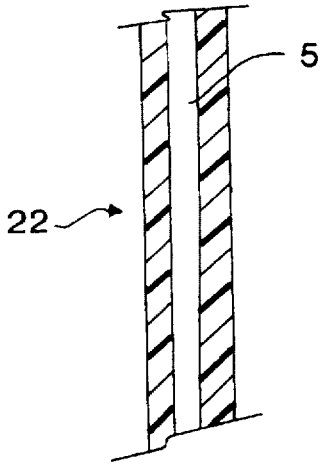
FIG. 7*a* is a cross sectional view of a profile piece such as the one shown in FIG. 2 along line VIIa—VIIa.
Figure 7B:
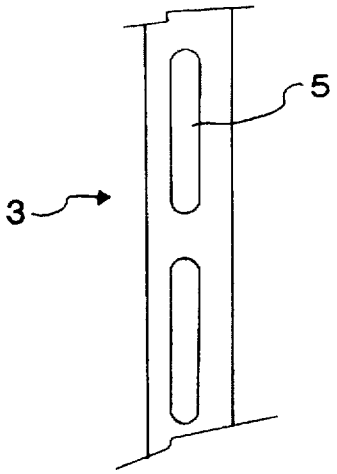
FIG. 7*b* is a cross sectional view of a middle ring such as the one shown in FIG. 2 along line VIIb—VIIb.

Thus, FIG. 7*a* shows a cross sectional view of a profile piece 22 such as the one shown in FIG. 2 alone line VIIa—VIIa. In FIG. 7*a*, profile piece 22 is shown as having been made of plastic and as having a groove 5 which runs continuously along the whole length of the profile. On the other hand, FIG. 7*b* shows a cross section of a middle ring 3 such as the one shown in FIG. 2 along line VIIb–VIIb, wherein groove 5 of middle ring 3 is discontinuous.

Profile 22 can be solid as shown or it can comprise a cavity therein extending over its whole length.

Figure 3:
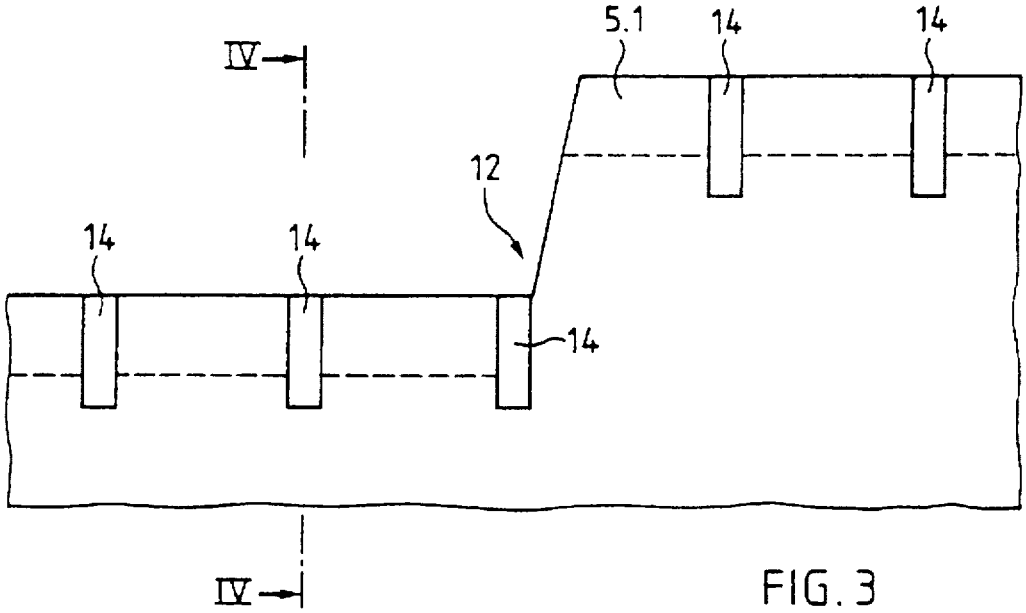
FIG. 3 shows a detailed view of exemplified engaging means in the form of a groove on an end or middle ring.
Figure 4:
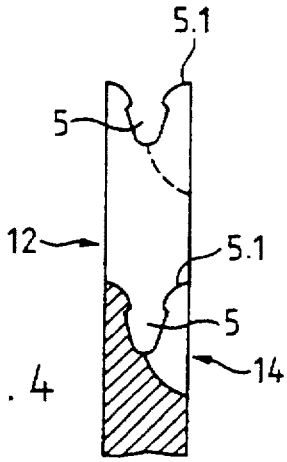
FIG. 4 shows a through the positive engaging means according to FIG. 3 cross-sectional view along line IV—IV and FIGS. 5 and 6 show diagrammatic views at the core along its rotational axis of two further exemplified embodiments of the hollow cylinder according to the invention.

FIGS. 3 and 4 show further embodiments of grooves constituting positive engaging means on rings (end ring and middle ring) which rings comprise a less easily elastically deformable or a mechanically stronger material than the profile piece used in conjunction with the rings. A middle ring made of a stronger material is advantageous for the application of a hollow cylinder as winding core, since the middle ring is the carrying element in this application and since the force produced by the tension of the winding tape acts on this ring, whereby the axially outer parts of the roll only have a supporting function.

In FIG. 3, the area of step 12 is shown viewed in a radial direction from the inside of the ring. The inner wall of the groove shows gaps 14. FIG. 4 shows an intersection of the stepped area (section line IV—IV, FIG. 3) on which again a gap 14 in the inner wall of groove 5.1 is shown.

Figure 5:
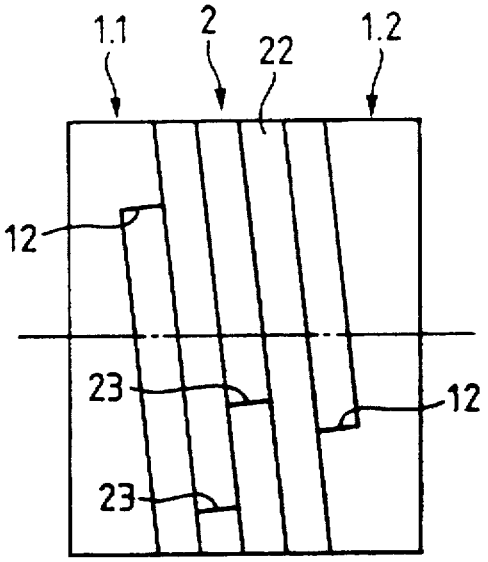

FIG. 5 diagrammatically shows a previously mentioned exemplified embodiment of the hollow cylinder according to the invention. This embodiment only comprises two end rings 1.1 and 1.2 and one coil part 2.

Coil part 2 is composed of a plurality of profile pieces 22 which abutting in butt points 23. If it is not a condition for a specific hollow cylinder that the surface area be uninterrupted, gaps between the profile pieces at butt points 23 are possible.

Figure 6:
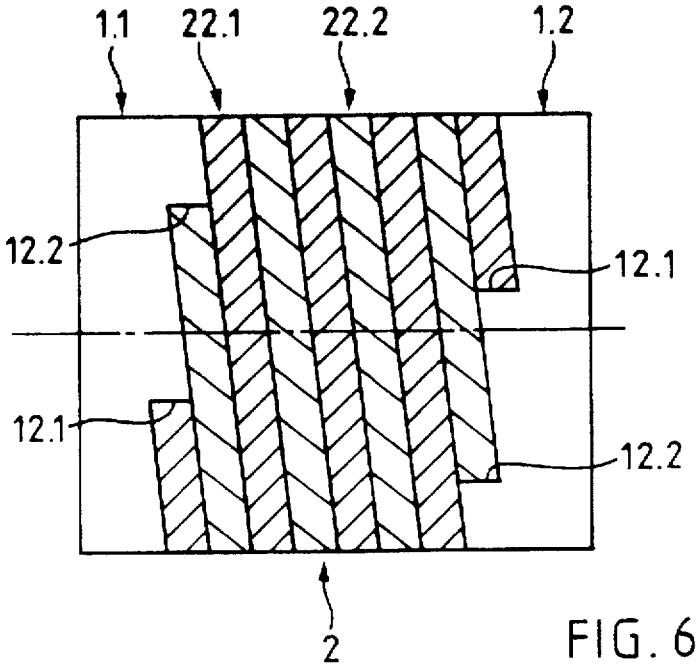

FIG. 6 shows a further previously mentioned embodiment with a coil part 2 including of a double coil i.e. of two profile pieces 22.1 and 22.2 coiled together. Of the end rings 1.1 and 1.2, each one comprises two corresponding steps 12.1 and 12.2.

I claim:

1. A winding core for winding printed products for forming rolls for intermediate storage, the winding core being shaped substantially as a hollow cylinder having a predetermined outer diameter and comprising:

two coil parts, each of the coil parts having an axial inner face and an axial outer face and including at least one coiled profile which has two axial sides and two ends, each of the coil parts further including a step on each of the inner face and the outer face thereof which step is formed by a corresponding one of the two ends of the at least one coiled profile, each coiled profile further comprising coil windings having cooperating first joining means disposed on the axial sides thereof for joining the windings to one another, each coiled profile having a freely selectable predetermined length thereby allowing an adjustment of an axial extension of the hollow cylinder;

two end rings including second joining means thereon cooperating with the first joining means for axially joining the two end rings to the coil parts, each end ring having an axial inner face facing a corresponding one of the coil parts, each inner face including a step thereon juxtaposed against and having an axial extension substantially equal to an axial extension of a corresponding step of the corresponding one of the coil parts; and a middle ring including third joining means thereon cooperating with the first joining means for axially joining the middle ring to the coil parts, the middle ring further having two faces, each of the two faces of the middle ring facing a corresponding one of the coil parts and having a step thereon juxtaposed against and having an axial extension substantially equal to an axial extension of a corresponding step of the corresponding one of the coil parts, each inner face facing an inner axial direction and each outer face facing an outer axial direction with respect to an axial center of the core.

2. The hollow cylinder according to claim 1, wherein:

the first joining means are configured to interlock for joining the windings to one another; and the first joining means, the second joining means and the third joining means are configured to interlock for joining the two end rings and the middle ring to the coil parts.

3. The hollow cylinder according to claim 2, wherein the first joining means, the second joining means and the third joining means each comprise a tongue and a corresponding groove, the first joining means further comprising a tongue on one side of each coiled profile and a corresponding groove on another side of each coiled profile.

4. The hollow cylinder according to claim 3, wherein:

the tongue comprises a neck portion and a head portion connected to and thicker than the neck portion; and the groove comprises a neck portion and an enlarged inner portion communicating with the neck portion.

5. The hollow cylinder according to claim 3, wherein the groove of at least one of the second joining means and the third joining means is discontinuous.

6. The hollow cylinder according to claim 1, wherein the first joining means, the second joining means and the third joining means are reversible joints.

7. The hollow cylinder according to claim 1, wherein each coiled profile is made of extruded plastic.

8. The hollow cylinder according to claim 7, wherein the extruded plastic profile is an open coil.

9. The hollow cylinder according to claim 8, wherein the windings of each coiled profile made from the extruded plastic profile are axially elastically pressed against one another.

10. The hollow cylinder according to claim 1, wherein the hollow cylinder is configured for producing rolls of flat items by winding the items thereabout.

* * * * *